US011214339B1

(12) United States Patent
Moran

(10) Patent No.: US 11,214,339 B1
(45) Date of Patent: Jan. 4, 2022

(54) NAUTICAL VESSEL DOCKING AND STORAGE SYSTEM

(71) Applicant: Michael Patrick Moran, Fort Myers Beach, FL (US)

(72) Inventor: Michael Patrick Moran, Fort Myers Beach, FL (US)

( * ) Notice: Subject to any disclaimer, the term of this patent is extended or adjusted under 35 U.S.C. 154(b) by 13 days.

(21) Appl. No.: 16/919,510

(22) Filed: Jul. 2, 2020

(51) Int. Cl.

| | |
|---|---|
| ***B63C 1/00*** | (2006.01) |
| ***B63B 23/02*** | (2006.01) |
| ***B63B 23/06*** | (2006.01) |
| ***B63B 23/32*** | (2006.01) |

(52) U.S. Cl.
CPC ..... *B63C 1/00* (2013.01); *B63B 23/02* (2013.01); *B63B 23/06* (2013.01); *B63B 23/32* (2013.01)

(58) Field of Classification Search
CPC .. B63C 1/00; B63C 1/02; B63B 23/00; B63B 23/02; B63B 23/32; B63B 23/42; B63B 21/00; B63B 23/06; B63B 35/40
USPC ..... 114/44, 366, 373
See application file for complete search history.

(56) References Cited

U.S. PATENT DOCUMENTS

| | | | | |
|---|---|---|---|---|
| 4,763,593 | A * | 8/1988 | Lasko | B63B 23/04 114/373 |
| 4,864,951 | A * | 9/1989 | Koepp, Jr. | B63B 23/32 114/44 |
| 5,133,275 | A * | 7/1992 | Maurizio | B63B 23/32 114/373 |
| 5,193,479 | A * | 3/1993 | Bielefeld | B63B 23/32 114/366 |
| 8,770,130 | B2 | 7/2014 | Holmes | |
| 9,308,971 | B2 * | 4/2016 | Isbill | B63B 23/02 |
| 10,145,073 | B2 | 12/2018 | Levin | |

* cited by examiner

*Primary Examiner* — Lars A Olson
(74) *Attorney, Agent, or Firm* — George F. Wallace

(57) ABSTRACT

A nautical vessel docking and storage system attaches to a nautical structure. A system includes a cradle having support elements that include lower portions, proximate and distal side portions, and proximate and distal side abutments; a vessel securing element; a hinge for each proximate side portion; and a puller for transitioning the cradle between docking and storage positions.

12 Claims, 5 Drawing Sheets

NAUTICAL VESSEL DOCKING AND STORAGE SYSTEM

FIELD OF THE INVENTION

The present invention relates to nautical vessel docking and storage.

BACKGROUND OF THE INVENTION

Nautical vessel docking systems have been provided to secure nautical vessels to a nautical structure, such as a dock or sea wall, which in turn are fixed to a landmass.

SUMMARY OF THE INVENTION

The present invention provides a nautical vessel docking and storage system.

An exemplary environment of the present invention can include a nautical structure, which can include any structural interface associated with a body of water and a landmass, such as a floating or stationary dock, piling, sea wall, anchor attached to a landmass, or nautical vessel, for example and not in limitation.

According to an exemplary embodiment of the present invention, a nautical vessel docking and storage system can include a cradle, a vessel securing element, hinges, and a puller, which cooperatively allow the system to transition between a docking position and a storage position.

In an exemplary aspect, a cradle can include first and second support elements, with each support element including a lower portion connected to proximate and distal side portions that can extend upwardly from the lower portion. A cradle can further include proximate and distal side abutments respectively connected to the support elements.

In another exemplary aspect, a vessel securing element can be connected to the cradle, and can be configured to extend, at least in part, between the proximate and distal side abutments to secure a docked nautical vessel against the support elements.

In still another exemplary aspect, a respective hinge can be connected to each proximate side portion, and then respectively connected to the nautical structure.

In a further exemplary aspect, a puller can be connected to the nautical structure, and can include a puller strap having a first strap end engaged with the puller and a second strap end engaged with the cradle.

In an exemplary use of the present invention, the cradle can be configured to pivotally transition from a docking position to a storage position. In a docking position, the lower portions can be generally parallel to the water surface of the body of water, and the proximate side abutment can abut the nautical structure to assist in stabilizing the cradle, such that a nautical vessel can be moved into the cradle, and to the extent desired, the nautical vessel can be secured to the cradle via the securing element.

In an exemplary aspect, to transition the cradle from a docking position to a storage position, the puller can be used to pull the puller strap, which can cause the cradle to pivot towards the nautical structure, such that the distal side abutment is positioned above the proximate side abutment.

In an exemplary aspect, when a cradle is in a docking position, the lower portions can be positioned below the water surface.

In another exemplary aspect, a cradle can optionally include at least one cross member connected to the first and second support elements.

In another exemplary aspect, the system can further include an extension fixed to the nautical structure, with the winch being attached to the extension.

In yet another exemplary aspect, a cradle can further include a middle abutment positioned between the proximate and distal side abutments and connected to the first and second support elements.

DETAILED DESCRIPTION

It is an object of the present invention to provide a nautical vessel docking and storage system having functional utility.

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of elements and/or aspects can enable a separate embodiment of the present invention, which may be claimed with particularity in this or any future filed Patent Applications. Moreover, such elements and/or aspects disclosed herein, whether expressly or implicitly, are to be construed strictly as illustrative and enabling, and not necessarily limiting. Therefore, it is expressly set forth that any elements and/or aspects, independently or in any combination of one of more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

According to the present invention, a nautical vessel docking and storage system can be formed from any one or more materials or combinations of materials, such as one or more of plastic, rubber, wood, metal, a crystalline material, or any other man-made or naturally occurring material, for example and not in limitation, insofar as functionally consistent with the invention as described. Further, such a system can be manufactured in any one or more functionally compatible manners, such as through molding, cutting, machining, etc. For example, such a system can be formed at least in part from aluminum pipe stock, which can be cut and/or bent and welded together.

Figure 1:
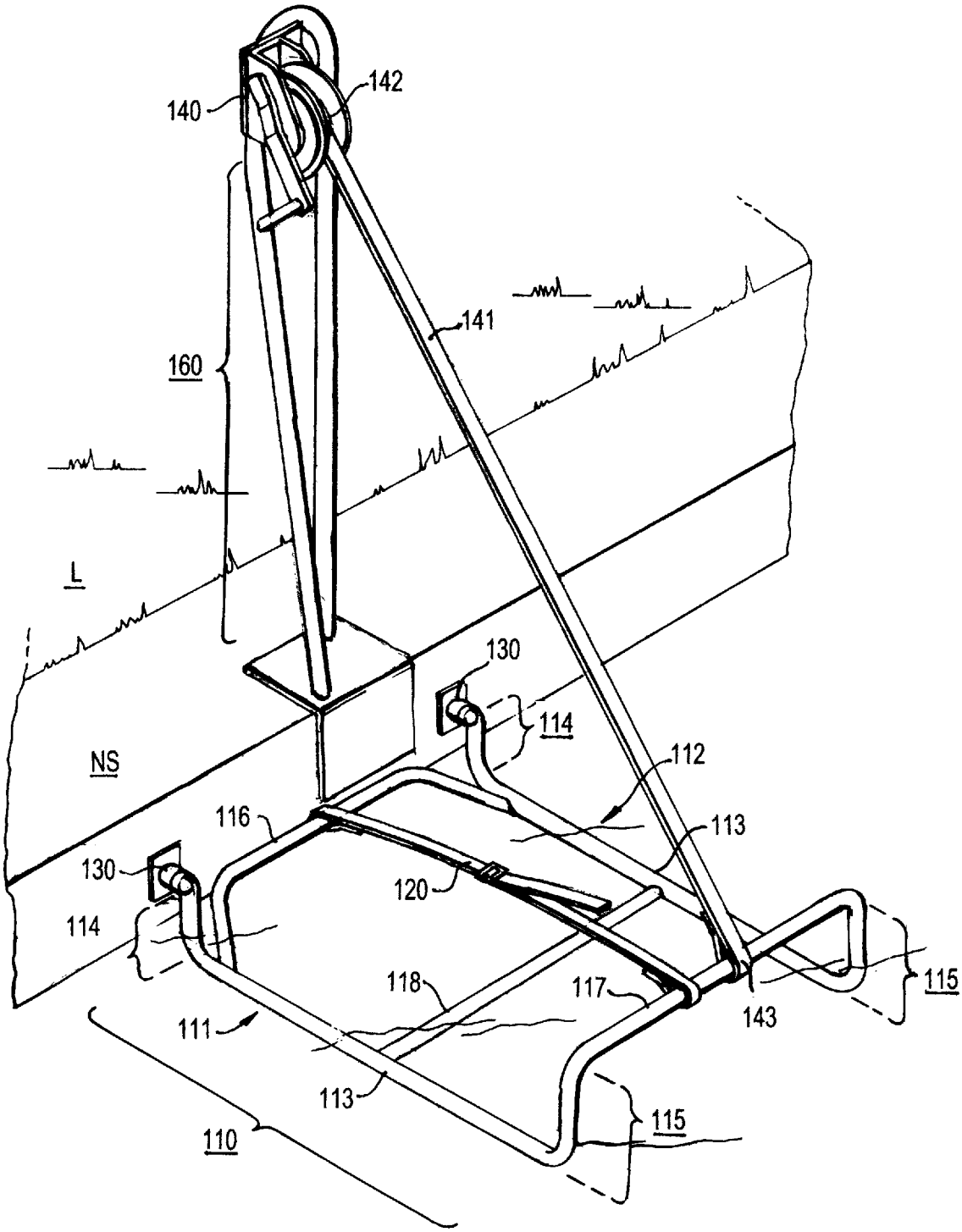
FIG. 1 illustrates an exemplary docking and storage system in a docking position.

FIG. 1 illustrates an exemplary environment of the present invention, in which the environment can include a nautical structure NS, which can include any structural interface associated with a body of water W and a landmass L, such as a floating or stationary dock, piling, sea wall, anchor attached to a landmass, or nautical vessel, for example and not in limitation.

Figure 2:
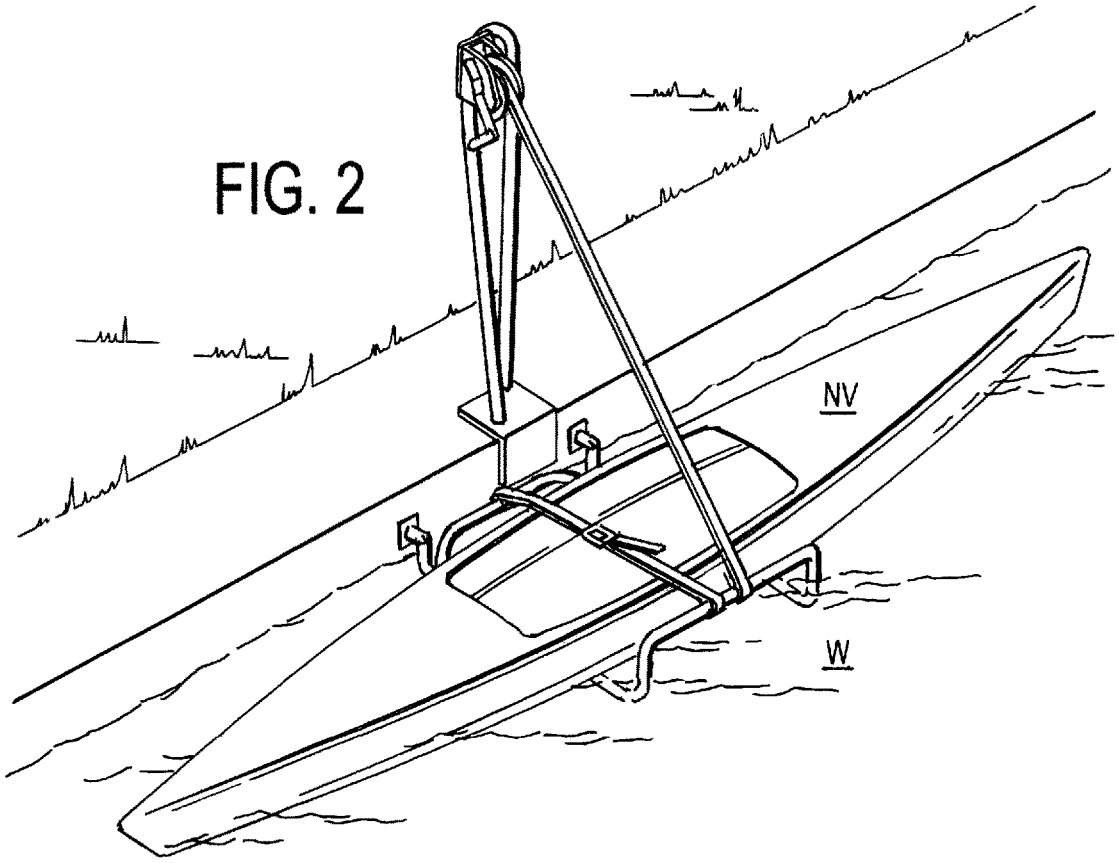
FIG. 2 illustrates an exemplary docking and storage system with a nautical vessel docked therewith.
Figure 3:
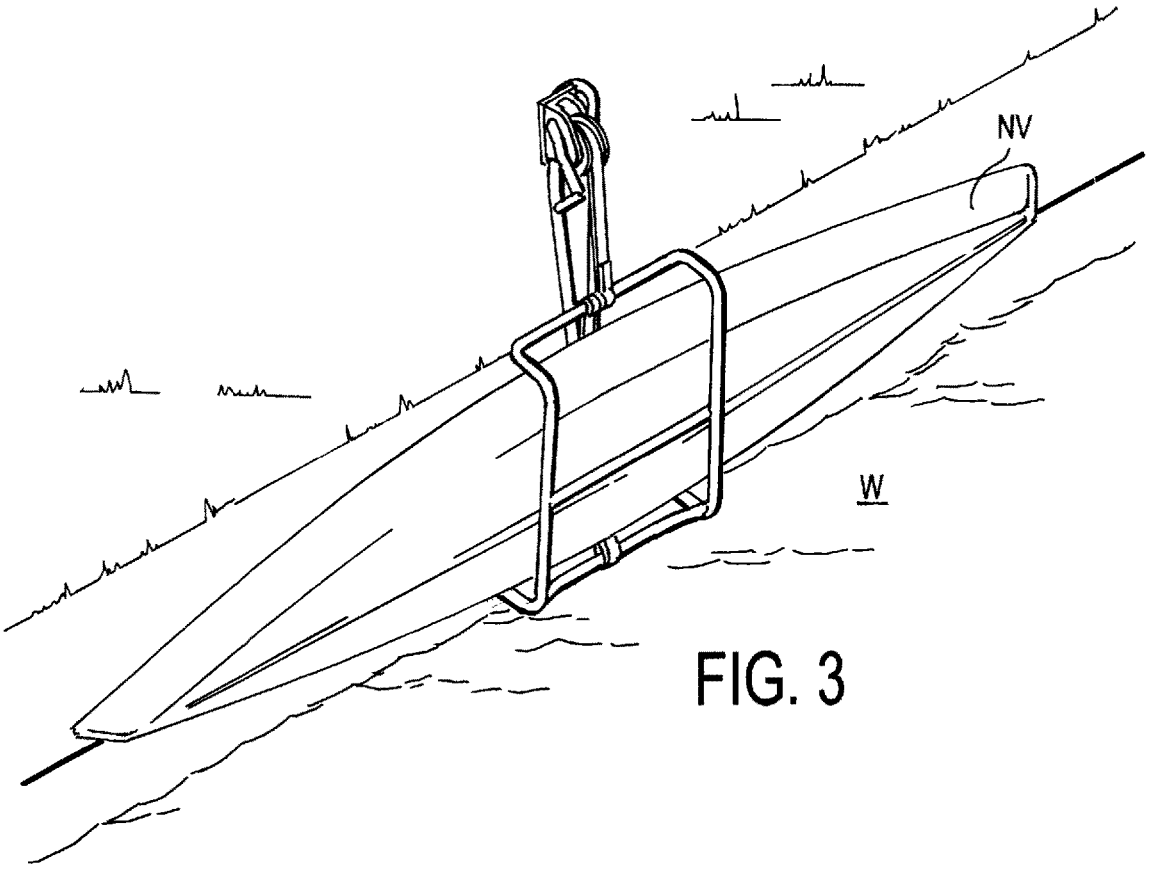
FIG. 3 illustrates an exemplary docking and storage system with a docked nautical vessel in a stored position.

FIG. 1 also illustrates an exemplary embodiment of the present invention, in which a nautical vessel docking and storage system 1 can include a cradle 110, a vessel securing element 120, hinges 130, and a puller 140, which cooperatively allow the system to transition between a docking position (as illustrated in FIG. 2) and a storage position (as illustrated in FIG. 3).

Referring to FIG. 1, in an exemplary embodiment of the present invention, a cradle 110 can include first and second support elements 111,112 with each support element including a lower portion 113 connected to proximate and distal side portions 114,115 that can extend upwardly from the lower portion as illustrated in FIG. 1. Support elements 111,112 can further respectively include proximate and distal side abutments 116,117 respectively connected to the support elements. As further illustrated, system 1 can additionally include a vessel securing element 120 connected to cradle 110, and optional cross member 118 connected to first and second support elements.

In a further exemplary aspect, support elements 111,112 can each provide a contact point or area for supporting a nautical vessel during docking and storage thereof. Notably, lower portions 113, proximate and distal side portions 114, 115, and proximate and distal side abutments 116,117 can be provided with any one or more linear, curvilinear, and irregular shapes to the extent desired and functionally compatible with the present invention.

Figure 4:
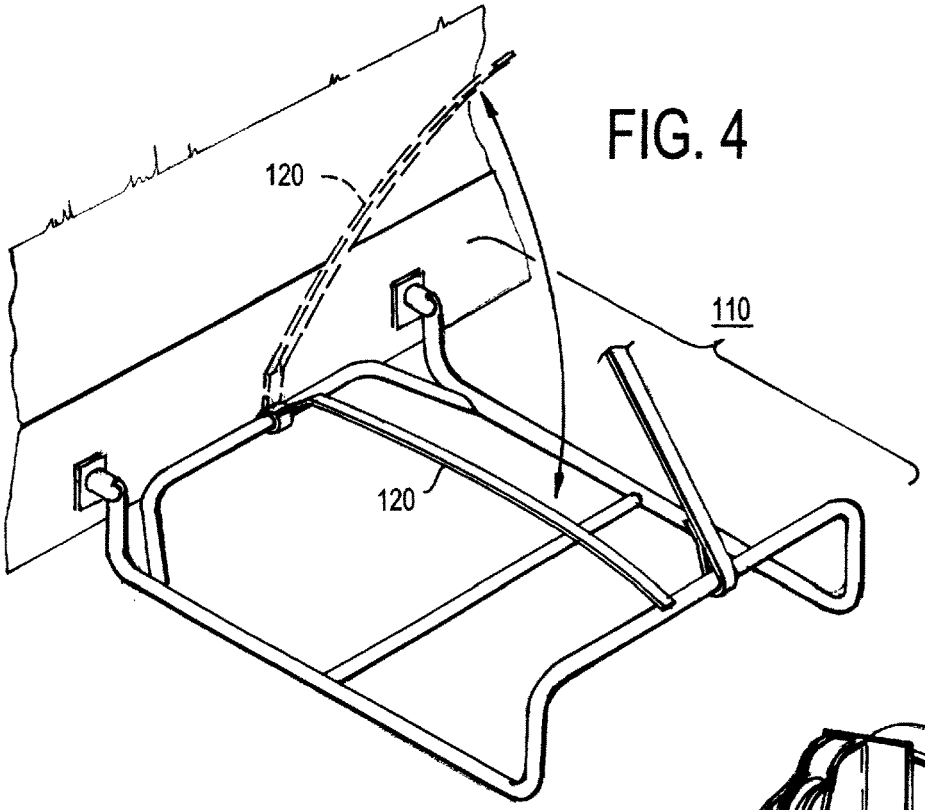
FIG. 4 illustrates an exemplary vessel securing element, connected to a cradle, and configured to extend between proximate and distal side abutments.

In another exemplary aspect, vessel securing element 120 can be provided to secure a docked vessel to cradle 110, and as illustratively shown in FIG. 1, can be connected to cradle 110 and configured to extend between proximate and distal side abutments 116,117. As illustratively shown, securing element 120 can be provided as a buckled strap attached to proximate and distal side abutments 116,117, and can secure, via tightening, nautical vessel NV to the cradle for secured docking and storage purposes. In another exemplary aspect, as illustrated in FIG. 4, vessel securing element 120 can be provided as a single structure, such as a clamp pivotally attached to cradle 110, and moveable between an open position and a closed position that can extend at least in part over proximate and distal side abutments to secure a nautical vessel to cradle 110.

Figure 5:
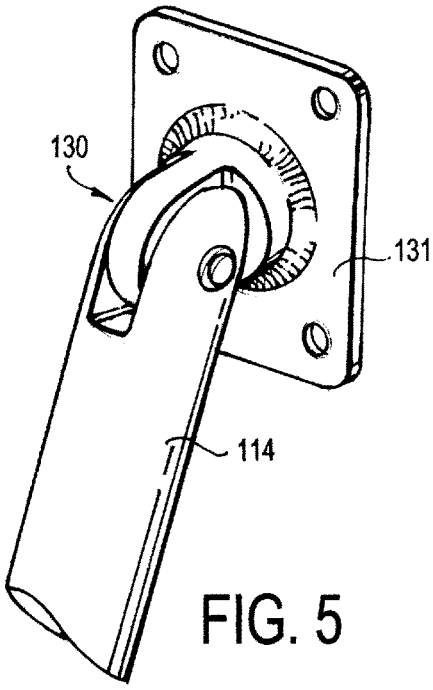
FIG. 5 illustrates an exemplary hinge having a hinge plate.

In a further exemplary aspect, a hinge 130 can be attached to each proximate side portion 114, and connected to nautical structure NS, such that cradle 110 can pivot about hinges 130 as the cradle transitions between docking and storage positions. For example, as illustrated in FIG. 5, hinge 130 can include a mounting plate 131 to facilitate attachment to a nautical structure NS. However, it should be noted that hinge 130 can be provided as any desired one or more known or apparent structural components to the extent the same is functionally compatible with the present invention as described.

Figure 6:
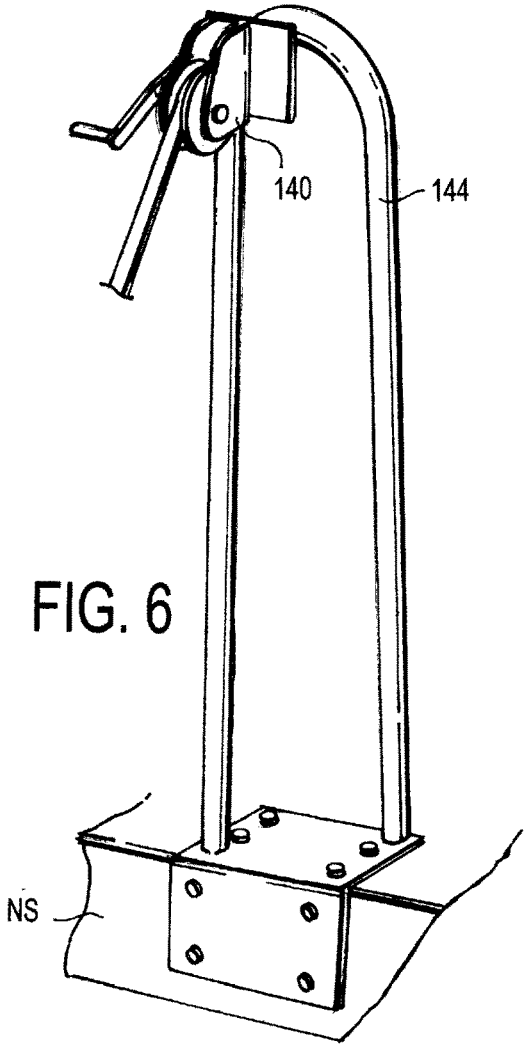
FIG. 6 illustrates an exemplary puller mounted to an extension.

In another exemplary aspect, a puller 140 can be connected to nautical structure NS and can include a puller strap 141 having a first strap end 142 engaged with the puller and a second strap end 143 engaged with cradle 110. Notably, while puller strap 141 is illustratively shown as being a strap, puller strap is not limited thereto and can be provided as any functionally compatible structure desired that is consistent with the present invention. Upon actuation of puller 140, puller strap 140 can be pulled towards the puller, which causes cradle 110 to pivot about hinges 130, which in turn causes the cradle to transition from a docking position to a storage position. Puller 140 can be provided as a manual puller (for example and not in limitation, as a pulley through which first strap end 142 can wrap and be available for manual pulling, or a mechanically actuated winch, as illustrated in FIG. 1, or an electric puller (such as a winch having an electric motor, for example and not in limitation). Optionally, as illustrated in FIG. 6, puller 140 can be connected to an optional extension 144, which can be fixed to nautical structure NS. Extension 144 can increase the relative height of puller 144 to facilitate its functionality with the instant invention.

Figure 7:
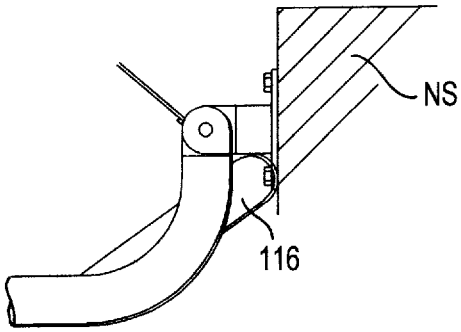
FIG. 7 illustrates an exemplary cradle in a docking position with proximate side abutment abutting nautical structure.
Figure 8:
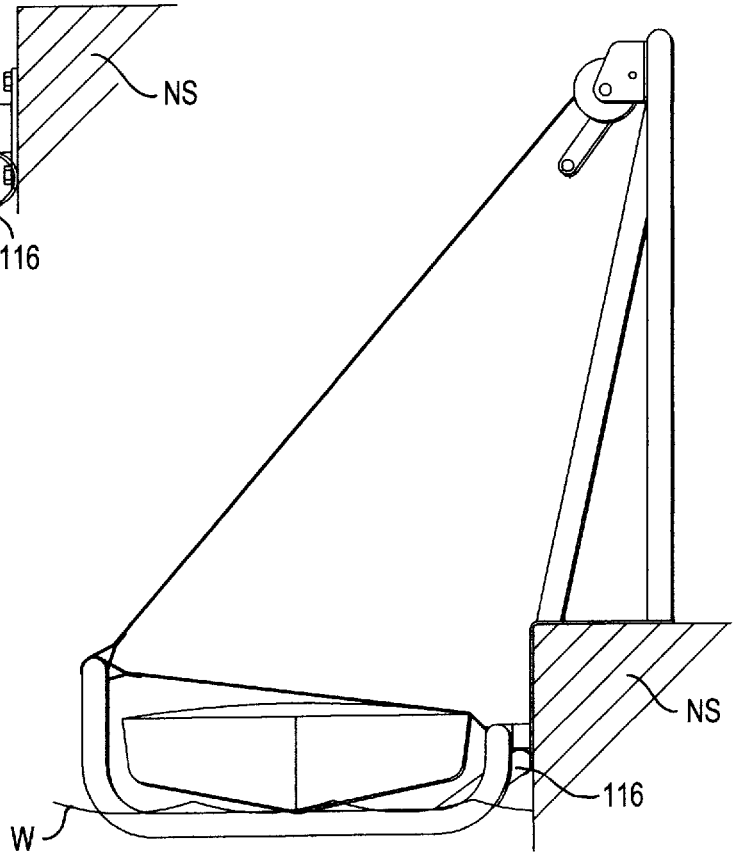
FIG. 8 illustrates another wider view of an exemplary cradle in a docking position with proximate side abutment abutting nautical structure.

FIGS. 1 and 2 illustrate an exemplary system in an exemplary docking position, in which cradle 110 can extend over water W, and proximate and distal side abutments 116,117 can define a channel, therebetween and, through which a nautical vessel can dock. In an optional exemplary aspect, as illustrated in FIGS. 7 and 8, when cradle 110 is in a docking position, proximate side abutment 116 can be configured to abut nautical structure NS to provide additional strength and stability to cradle 110.

FIG. 2 illustrates an exemplary system having an exemplary nautical vessel NV docked with cradle 110, in which the nautical vessel can be positioned between proximate and distal side abutments 116,117. Optionally, vessel securing element 120 can be extended between the side abutments and over the nautical vessel NV to secure it within cradle 110.

FIG. 3 illustrates an exemplary system in an exemplary storage position, in which a docked nautical vessel NV is secured within cradle 110 via vessel securing element 120, and actuation of puller 140 can pivot the cradle and nautical vessel about hinges 130 from a docking position to the storage position. Notable, a storage position can include any position of cradle 110 from just above the docking position to a position perpendicular to water W (about 90°) or beyond perpendicular insofar as desired.

Figure 9:
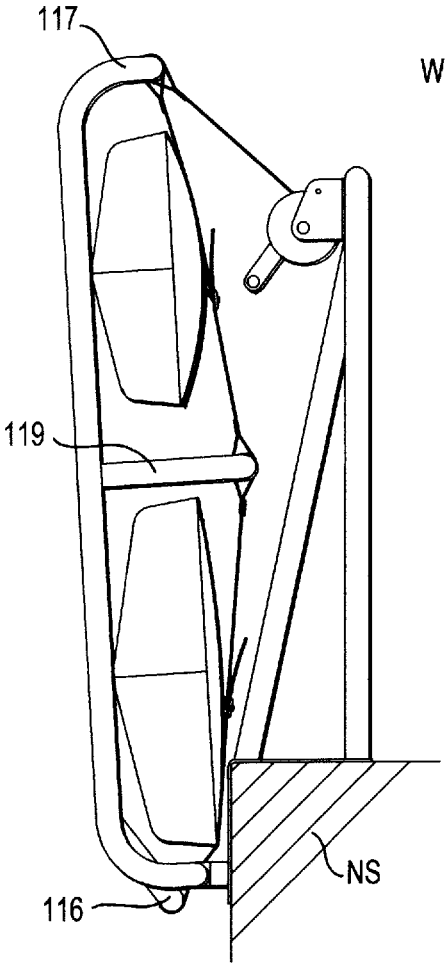
FIG. 9 illustrates an exemplary system configured for docking and storing plural nautical vessels simultaneously.
Figure 10:
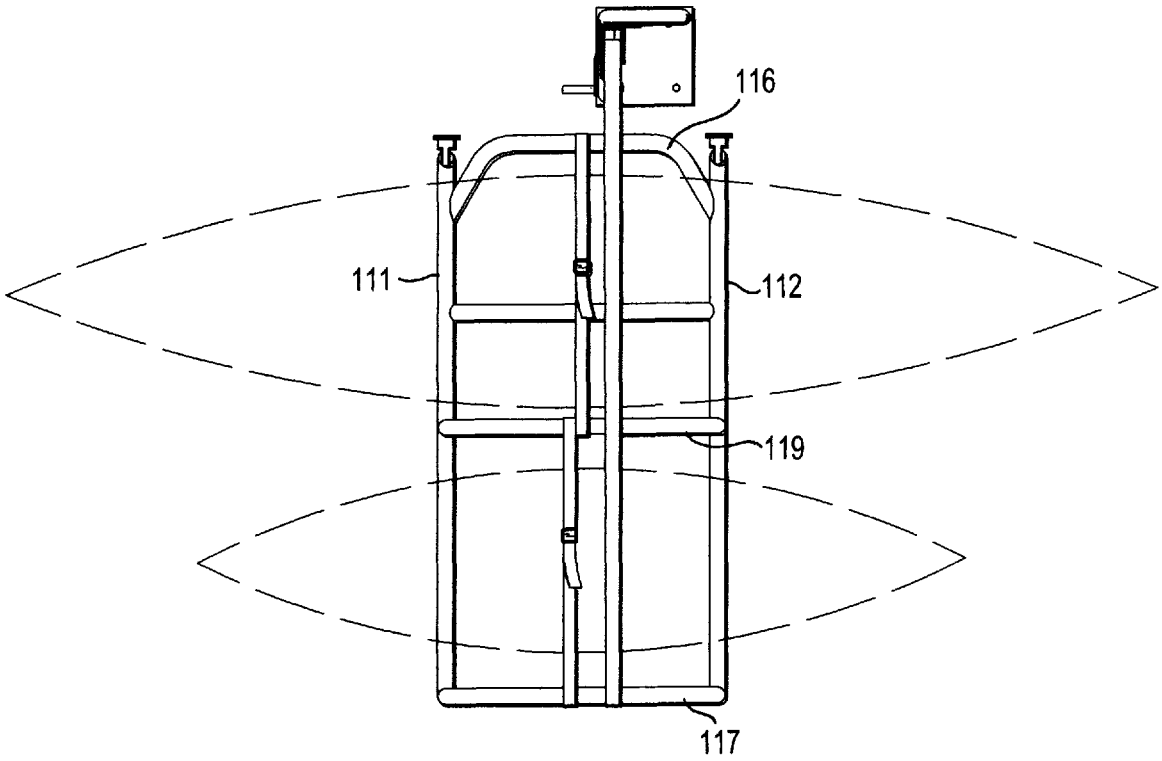
FIG. 10 illustrates a top-view of an exemplary system configured for docking and storing plural nautical vessels simultaneously.

Referring now to FIGS. 9 and 10, cradle 110 can optionally be configured to support another nautical vessel via optional inclusion of a middle abutment 119 positioned between proximate and distal side abutments 116,117 and connected to the first and second support elements 111,112. As illustratively shown, proximate side and middle abutments 116,119 can define a first channel therebetween, whilst middle and distal side abutments 119,117 can define a second channel therebetween. Further, transitioning between docking and storage positions in the exemplary embodiment can the same or similar to that with a single vessel arrangement.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore, I claim:

1. A nautical vessel docking and storage system attached to a nautical structure and adjacent to a body of water having a water surface, said system comprising:

a cradle having first and second support elements, each support element having a respective lower portion and proximate and distal side portions extending away from the respective lower portion, proximate and distal side abutments respectively connected to the first and second support elements;

a vessel securing element connected to said cradle and configured to extend at least in part between the proximate and distal side abutments;

a respective hinge for and connected to each proximate side portion, each hinge being further connected to the nautical structure; and a puller connected to the nautical structure, said puller including a puller strap having a first strap end engaged with said puller and a second strap end engaged with said cradle;

wherein said cradle is configured to pivotally transition from a docking position, in which the lower portions are parallel with the water surface and the proximate side abutment abuts the nautical structure, to a storage position, in which said cradle pivots via the hinges towards the nautical structure such that the distal side abutment is positioned above the proximate side abutment.

2. The system of claim 1, wherein when said cradle is in the docking position, the lower portions are configured to be positioned below the water surface.

3. The system of claim 1, wherein the second strap end is connected to the distal side abutment.

4. The system of claim 1, wherein said cradle includes at least one cross member connected to the first and second support elements.

5. The system of claim 1, further comprising an extension fixed to the nautical structure and attached to said puller.

6. The system of claim 1, wherein said puller is provided as a winch.

7. The system of claim 1, wherein said cradle further has a middle abutment positioned between the proximate and distal side abutments and connected to the first and second support elements.

8. The system of claim 7, wherein when said cradle is in the docking position, the lower portions are configured to be positioned below the water surface.

9. The system of claim 7, wherein the second strap end is connected to the distal side abutment.

10. The system of claim 7, wherein said cradle includes at least one cross member connected to the first and second support elements.

11. The system of claim 7, further comprising an extension fixed to the nautical structure and attached to said puller.

12. The system of claim 7, wherein said puller is provided as a winch.

* * * * *